US006217390B1

(12) United States Patent
Casari

(10) Patent No.: US 6,217,390 B1
(45) Date of Patent: Apr. 17, 2001

(54) AC ADAPTOR FOR COMPUTER

(76) Inventor: Derek A. Casari, 15477 Dickens St., Sherman Oaks, CA (US) 91403

( * ) Notice: Subject to any disclaimer, the term of this patent is extended or adjusted under 35 U.S.C. 154(b) by 0 days.

(21) Appl. No.: 09/419,106

(22) Filed: Oct. 15, 1999

(51) Int. Cl.[7] ..... H01R 25/00
(52) U.S. Cl. ..... 439/651
(58) Field of Search ..... 439/651, 652, 439/655, 105, 106, 108

(56) References Cited

U.S. PATENT DOCUMENTS 3,626,354 * 12/1971 Banner ..... 439/651
5,007,857 * 4/1991 Wright ..... 439/651
5,626,495 * 5/1997 Drewnicki ..... 439/651

* cited by examiner

*Primary Examiner*—Paula Bradley
*Assistant Examiner*—Shanetta D. Ore

(57) ABSTRACT

AC Adaptor for Computer with a molded plastic housing containing a recessed portion at one end having standard IEC male tripe conductive prongs contained therein and at the housings opposite end having a standard female AC receptacle contained therein, and conductive connections within the housing connecting the IEC prongs to said standard AC receptacle.

1 Claim, 2 Drawing Sheets

AC ADAPTOR FOR COMPUTER

BACKGROUND OF THE INVENTION

This invention relates generally to the field of AC adaptors, and more particularly to an AC Adaptor for Computer.

Personal computers have been available for over twenty five years. It is common to have to plug in and power additional items relating to a computer such as a printer, monitor, and the like. To this end many computers are fitted with IEC type female power ports for providing electrical power to auxiliary pieces of equipment. The IEC port is different in configuration from a standard AC power outlet such as those found in a common wall outlet in a home or office. As an electronics technician working in television production I have seen a need for the ability to plug in a piece of test equipment while working on a computer. The most convenient location to plug in the test equipment would be the IEC port of the computer, however it, to computer does not allow a person to plug in a piece of equipment having a standard AC plug. There are some extension cords available such as ones available from Pacific Radio Electronics of Los Angeles, Calif. that have an IEC male prongs on one end and a standard AC at the opposite end, however, they are bulky and relatively expensive. There is therefore a need for a compact, inexpensive adaptor device that can convert an IEC type female receptacle located on the outer surface of a computer to a standard AC type female receptacle.

SUMMARY OF THE INVENTION

The primary object of the invention is to provide an additional AC power outlet at the rear of a personal computer.

Another object of the invention is to provide an adaptor that is compact and does not require an extension cord.

Another object of the invention is to provide an economical means to obtain an additional AC power outlet within close proximity to a computer.

Other objects and advantages of the present invention will become apparent from the following descriptions, taken in connection with the accompanying drawings, wherein, by way of illustration and example, an embodiment of the present invention is disclosed.

AC Adaptor for Computer comprising: a molded plastic housing containing a recessed portion at one end having standard IEC male type conductive prongs contained therein and at the housings opposite end having a standard female AC receptacle contained therein, and conductive connections within the housing connecting the IEC prongs to the standard AC, receptacle.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
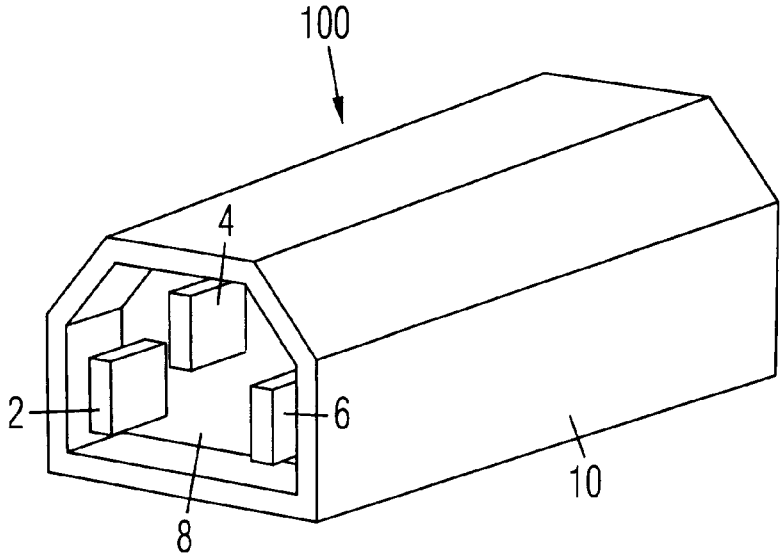
FIG. 1 is a perspective view showing IEC prong portion of the AC adaptor of the present invention.
Figure 2:
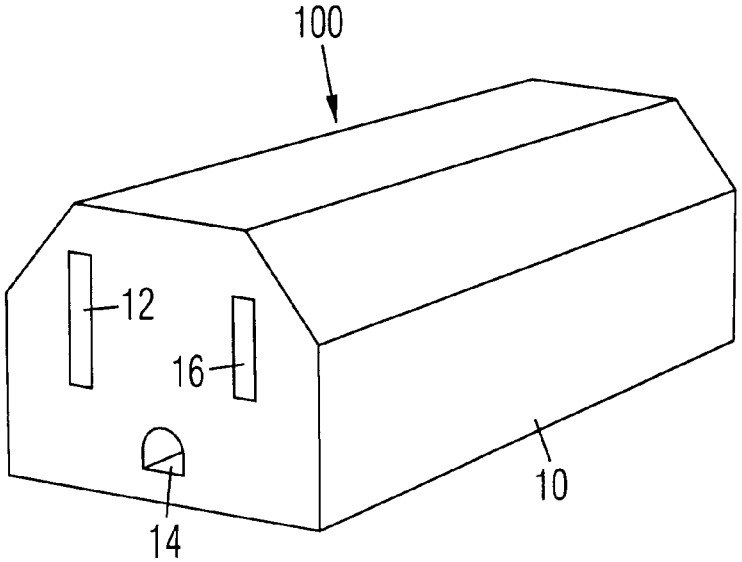
FIG. 2 is a perspective view showing the standard AC receptacle portion of the AC adaptor of the present invention.
Figure 3:
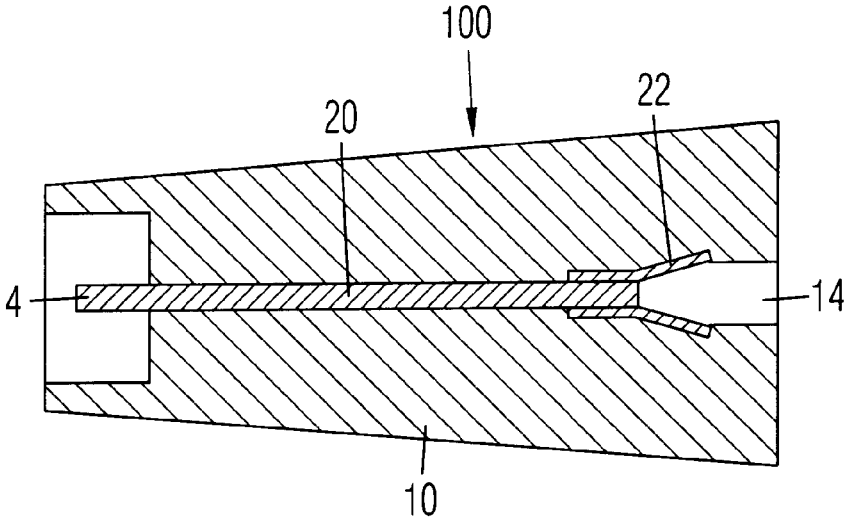
FIG. 3 is a side section view of the AC adaptor of the present invention.

Referring now to FIG. 1 we see a perspective view of the AC adaptor of the present invention 100 as seen from a concave end 8 with a tubular shroud 3 surrounding recessed IEC prongs 2, 4, 6 of identical rectangular cross-section. This IEC configuration is found at the rear portion of many of todays personal computers and is used to plug in computer peripheral components. Prongs 2, 4, 6 are made of conductive metal such as steel. Housing 10 is made of nonconductive rigid, molded plastic such as nylon or PVC or the like. FIG. 2 shows the female receptacle portion of the AC adaptor of the present invention 100 that is designed to accommodate standard 120 volt AC plugs found on most equipment requiring an electric AC power source. Female sockets 12, 14, 16 are molded into a flat end 18 of housing 10. Sockets 12 and 16 are rectangular slots, and socket 14 is a semi-circular hole. Internally, as shown in side section FIG. 3, IEC prong 4 is connected by metal conductor 20 to metal receptacle 22 at the base of socket 14. The same holds true for connections between prong 2 and socket 16 as well as prong 6 and socket 12. In this way an AC adaptor is constructed in an economical and compact fashion that allows a person to convert an IEC type power port into a standard AC type outlet.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An AC adapter for a computer, comprising:

a single rigid housing with a concave end and a flat end;

a tubular shroud at said concave end of said housing;

three male prongs attached to said concave end of said housing and fully recessed within said tubular shroud;

wherein all of said male prongs have identical rectangular cross-sections;

wherein said concave end of said housing is adapted to be plugged into a conventional IEC power port on a conventional computer;

three female sockets at said flat end of said housing; and three conductors connected between said male prongs and said female sockets to provide a straight-through connection;

wherein said female sockets are adapted to receive a conventional AC power plug from an electrical device, so that said AC adapter is adapted to connect said conventional AC power plug to said International Electroctechnical Commission (IEC) power port on said computer for powering said electrical device through said computer.

* * * * *